US009121163B2

(12) United States Patent
Ditzler et al.

(10) Patent No.: US 9,121,163 B2
(45) Date of Patent: Sep. 1, 2015

(54) EXOSKELETON BOOM STRUCTURE

(75) Inventors: Steven J. Ditzler, Bellevue, IA (US); Henry J. Stulen, Paris (CA)

(73) Assignee: Deere & Company, Moline, IL (US)

( * ) Notice: Subject to any disclaimer, the term of this patent is extended or adjusted under 35 U.S.C. 154(b) by 729 days.

(21) Appl. No.: 13/236,935

(22) Filed: Sep. 20, 2011

(65) Prior Publication Data

US 2013/0071216 A1 Mar. 21, 2013

(51) Int. Cl.
*E02F 3/38* (2006.01)
*E04C 3/04* (2006.01)

(52) U.S. Cl.
CPC ..... *E02F 3/38* (2013.01); *E04C 2003/0413* (2013.01); *E04C 2003/0465* (2013.01)

(58) Field of Classification Search
CPC ..... E02F 3/38; E02F 3/382; E02F 3/384; E02F 9/14; E04C 2003/0413; E04C 2003/0465; Y10S 414/131
USPC ..... 52/111, 166, 843; 414/543, 680, 685, 414/686, 687, 691, 694, 695.5, 722, 723, 414/727, 918
See application file for complete search history.

(56) References Cited

U.S. PATENT DOCUMENTS

| | | | | |
|---|---|---|---|---|
| 3,295,699 | A | 1/1967 | Bauernschub | |
| 3,616,940 | A | 11/1971 | Milner | |
| 3,890,757 | A * | 6/1975 | Lamer et al. | 52/695 |
| 4,045,936 | A * | 9/1977 | Sterner | 52/632 |
| 4,112,649 | A * | 9/1978 | Fritsch et al. | 52/843 |
| 4,260,064 | A | 4/1981 | Ekstam | |
| 5,806,313 | A | 9/1998 | Koshi | |
| 6,322,280 | B1 | 11/2001 | Coyne | |
| 6,443,196 | B1 | 9/2002 | Kurelek | |
| 6,612,051 | B2 | 9/2003 | Weyer | |
| 6,872,043 | B2 | 3/2005 | Yukawa | |
| 7,008,169 | B1 | 3/2006 | Miyanishi | |
| 7,814,730 | B2 * | 10/2010 | Grobenstieg et al. | 52/843 |
| 2002/0170212 | A1 * | 11/2002 | Sasaki et al. | 37/466 |

(Continued)

FOREIGN PATENT DOCUMENTS

IN 239227 9/2011

OTHER PUBLICATIONS

Notification of Transmittal of the International Search Report and the Written Opinion of the International Searching Authority, or the Declaration; International Search Report; Written Opinion of the International Searching Authority (10 pages) (Mar. 28, 2013).

(Continued)

*Primary Examiner* — Saul Rodriguez
*Assistant Examiner* — Brendan Tighe
(74) *Attorney, Agent, or Firm* — Taft Stettinius & Hollister LLP; Stephen F. Rost

(57) ABSTRACT

The present disclosure provides a boom structure including an elongated body having a first end and a second end, the first end configured to couple to a dipper and the second end configured to couple to a support structure. The boom structure further includes a top member, a bottom member, and a pair of sides members of the body coupled to the top member and bottom member. Each side member includes a first portion extending between the first end and second end of the body and forming an outer frame structure. Each side member also includes a second portion coupled to an inner surface of the first portion and being substantially enclosed by the first portion.

22 Claims, 7 Drawing Sheets

(56) References Cited

U.S. PATENT DOCUMENTS

| | | | | |
|---|---|---|---|---|
| 2009/0223093 | A1* | 9/2009 | Willaredt et al. | 37/403 |
| 2011/0002765 | A1* | 1/2011 | Asam et al. | 414/722 |
| 2012/0241404 | A1 | 9/2012 | Bobeck | |
| 2013/0142607 | A1* | 6/2013 | Ditzler | 414/727 |
| 2014/0334906 | A1* | 11/2014 | Takahashi et al. | 414/727 |

OTHER PUBLICATIONS

Images of Deere Boom (2 pages) (admitted as prior art before Sep. 20, 2011).

Background Information (1 page) (admitted as prior art before Sep. 20, 2011).

Report of Indian Design Patent No. 239227 (1 page) (Sep. 5, 2011).

Notification of Transmittal of the International Search Report and the Written Opinion of the International Searching Authority, or the Declaration; International Search Report; Written Opinion of the International Searching Authority (13 pages) (May 3, 2013).

Notification of Transmittal of the International Search Report and the Written Opinion of the International Searching Authority, or the Declaration; International Search Report; Written Opinion of the International Searching Authority (11 pages) (Apr. 29, 2013).

* cited by examiner

EXOSKELETON BOOM STRUCTURE

FIELD OF THE INVENTION

The present invention relates to a boom of a work vehicle, and in particular to an exoskeleton boom structure.

BACKGROUND OF THE INVENTION

Work vehicles can be equipped with booms for doing excavation, harvesting, logging and other heavy-duty work. In FIG. 1, for example, a work vehicle 100 such as a tracked harvester is shown. The vehicle 100 includes an undercarriage 102 to which a ground engaging assembly 104 is provided for supporting and propelling the vehicle 100. The ground engaging assembly 104 can include tracks, as shown, or alternatively may include tires. The vehicle 100 is provided with a supporting structure 106 which is disposed upon the undercarriage 102. A cab 108 is disposed adjacent to the support structure 106 and can include control levers, joysticks, and other assemblies for controlling the movement and operation of the vehicle 100.

The work vehicle can also include a work attachment 110, such as a single grip harvesting head, for performing a working operation (e.g., logging). The work attachment 110 is pivotally mounted to one end of a dipper stick 112 which in turn is pivotally mounted to a boom 116. A first hydraulic cylinder (not shown) is used for pivoting the work attachment 110 relative to the dipper stick 112. Similarly, a second hydraulic cylinder 114 is provided for pivoting the dipper stick 112 relative to the boom 116 and a third hydraulic cylinder 118 is provided for pivoting the boom 116 relative to the supporting structure 106. The supporting structure 106 can be pivoted relative to the undercarriage 102 by a hydraulic motor (not shown). Although the work vehicle 100 is described for use as a tracked harvester, the embodiments of the present disclosure are not limited to the tracked harvester and may be incorporated in other work vehicles including a tracked feller buncher, wheeled feller buncher, etc.

The boom 116 is an elongated body that is loaded at both ends thereof during operation and is also heavily loaded at cylinder attachment points. Conventional booms are formed by materials having different thicknesses which are welded together. The boom structure is designed to achieve a desirable strength and service (fatigue) life, but also maintain a desirable weight that allows the hydraulic cylinder to operably control the boom. If a boom weighs too much, for example, the hydraulic cylinder can have difficulty controlling the boom during operation.

To achieve a desired strength and weight, a conventional boom will include side members having a thicker portion near each end and a thinner portion therebetween. One such example is illustrated in FIG. 2. A boom 200, similar to the boom 122 of FIG. 1, is shown having a first end 202 and a second end 204. For instance, the first end 202 of the boom 200 can be pivotally coupled to one end of a dipper and the second end 204 can be pivotally coupled to a support structure. The boom 200 also includes a set of cylinder lugs 212 near the middle for coupling to a hydraulic cylinder. The structural design of the boom 200 includes a top member 214, a pair of side members 206, and a bottom member 220. Each of the side members 206 is formed by a first, thicker body 210 disposed near the first end 202 and second end 204 and a second, thinner body 208 disposed in between. The thinner body 208 can have a thickness of about 10-20 mm and the thicker bodies 210 can have a thickness of about 40-50 mm. The thicker bodies 210 and thinner body 208 are welded together to form the side member 206. Likewise, the side members 206 are welded to the top member 214 and bottom member 220.

There are several shortcomings found in the structural design of the conventional boom 200. First, the interfaces 216, 218 between the thicker bodies 210 and thinner body 208 can form significant stress risers which reduce the strength of the boom 200. The stress risers can eventually cause cracks near each interface 216, 218. In addition, the thinner body 208 is susceptible of being dented or damaged during boom operation and therefore weakening the boom structure, particularly since the thinner body 208 is welded directly to the top member 214, bottom member 220, and each thicker body 210.

Another shortcoming of the conventional boom structure is the required use of a weld support or backup bar. Referring to FIG. 3, an example of a weld support bar 300 is shown. In this illustration, the top member 214 is removed so that the weld support bar 300 is visible. The weld support bar 300 comprises a series of individual, elongated bars or rods of material welded at the interface of the top member 214 and side members 206. The size and shape of these support bars 300 can be difficult to weld and do not form a continuous, uniform weld backup. Cracking or other failures can occur at locations where there is a discontinuity or interruption between adjacently welded support bars 300 (i.e., along the length of the boom). Further, the weld interface between the top member 214 and side members 206 formed a fillet weld, which provides less strength and support to the boom compared to a penetration weld.

A need therefore exists to provide a boom having a structural design that possesses an increased strength, without increasing the weight of the boom, and includes a continuous weld backup.

SUMMARY

In an exemplary embodiment of the present disclosure, a boom structure including an elongated body having a first end and a second end, the first end configured to couple to a dipper and the second end configured to couple to a support structure. The boom structure further includes a top member, a bottom member, and a pair of sides members of the body coupled to the top member and bottom member. Each side member includes a first portion extending between the first end and second end of the body and forming an outer frame structure. Each side member also includes a second portion coupled to an inner surface of the first portion and being substantially enclosed by the first portion. The first portion can have a greater thickness than the second portion.

In one aspect of this embodiment, the boom structure includes a lug portion defined by the first portion. In another aspect, the boom structure includes a uniform and continuous weld backup. The second portion can form the weld backup. In an alternative aspect, the boom structure can include a top edge of the second portion welded to a bottom edge of the top member and a bottom edge of the second portion welded to a top edge of the bottom member.

In one embodiment, the boom structure can further include a penetration weld formed between the interfaces of the first portion and second portion, top member and second portion, and bottom member and second portion. In addition, a substantially H-shaped cross-section is defined at the interface of the top member, first portion and second portion. Also, the first portion defines an opening disposed within the outer frame structure and the second portion completely covers the defined opening in the first portion.

The first portion can extend past the top member to define a flange-like structure. Further, the boom structure can include a recess defined between the top member and first portion of the pair of side members. In addition, the relationship between the first portion and second portion can be such that the first portion is at least twice as thick as the second portion.

In another embodiment, a work vehicle includes an undercarriage and a ground engaging assembly for supporting and propelling the vehicle; a support structure disposed upon the undercarriage, the support structure being pivotally mounted to the undercarriage; a work attachment for performing a work operation; a dipper stick pivotally coupled to the work attachment; and a boom pivotally coupled to the dipper stick at a first end and to the support structure at an opposite end thereof. The boom comprises an elongated body having a top member and a bottom member of the body; and a pair of sides members coupled to the top member and bottom member, each side member including a first portion and a second portion, where the first portion extends between the first end and the second end of the body and forms an outer frame structure and the second portion couples to an inner surface of the first portion and is substantially enclosed by the first portion; wherein, the first portion can have a greater thickness than the second portion.

In one aspect, the second portion defines a uniform and continuous weld backup. Related thereto, a top edge of the second portion is welded to a bottom edge of the top member; and a bottom edge of the second portion is welded to a top edge of the bottom member. In another aspect, a penetration weld is formed between the interfaces of the first portion and second portion, top member and second portion, and bottom member and second portion. In a different aspect, a substantially H-shaped cross-section is defined at the interface of the top member, first portion and second portion.

In this embodiment, the first portion defines an opening disposed within the outer frame structure; and the second portion completely covers the defined opening. Alternatively, a recess is defined between the top member and first portion of the pair of side members. In this arrangement, the first portion extends past the top member to define a flange-like structure.

An advantage of the present disclosure is a reduction in stress risers at the interface or adjoining of the first and second portions of the side members. The first portion can provide an outer, frame-like structure that defines the side member, whereas the second portion has a reduced thickness encompassed within a window-like portion defined in the first portion. This new structural design reduces or eliminates the stress risers found in conventional boom structures and provides improved strength to the boom. In addition, the frame-like structure defined by the first portion provides support to the boom against objects and debris that impact the boom. In conventional booms, the thinner portion of the side members extends from the top to the bottom panels of the boom and can be dented or damaged when impacted by debris. The new design is better able to withstand debris. Also, the first portion can define the cylinder lug for coupling to a hydraulic cylinder. This eliminates the need for a separate lug portion to be welded to the boom and create additional stress risers.

The second portion also allows the boom to have a maintained weight so the hydraulic cylinder can operably control the functionality of the boom. The second portion has a thickness less than the first portion, and this reduced thickness allows the boom to have less weight than if the second member was completely formed by the first portion.

Another advantage of the present disclosure is the continuous and uniform weld backup defined by the second portion of each side member. The continuous weld backup allows for a complete penetration weld which adds strength and support to the boom. The improved weld backup also eliminates the need of weld backup bars. As previously noted, backup bars are commonly used in conventional booms to support the weld interface between various members. The backup bars, however, cannot form a continuous weld, and therefore interruptions or gaps between the bars give rise to stress risers and cracks. The continuous and uniform weld backup formed by the second portion of the embodiments of the present disclosure reduce or eliminate the stress risers and potential cracks.

A further advantage of the present disclosure is the H-shaped cross-section formed by the first portion, second portion, and top member of the boom. This cross-section defines a recess or trough between the first portion and top member such that hoses, wires, fittings, etc. can be disposed within the recess or trough to add shielded from potential debris and damage.

BRIEF DESCRIPTION OF THE DRAWINGS

The above-mentioned aspects of the present invention and the manner of obtaining them will become more apparent and the invention itself will be better understood by reference to the following description of the embodiments of the invention, taken in conjunction with the accompanying drawings, wherein.

Corresponding reference numerals are used to indicate corresponding parts throughout the several views.

DETAILED DESCRIPTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

Figure 4:
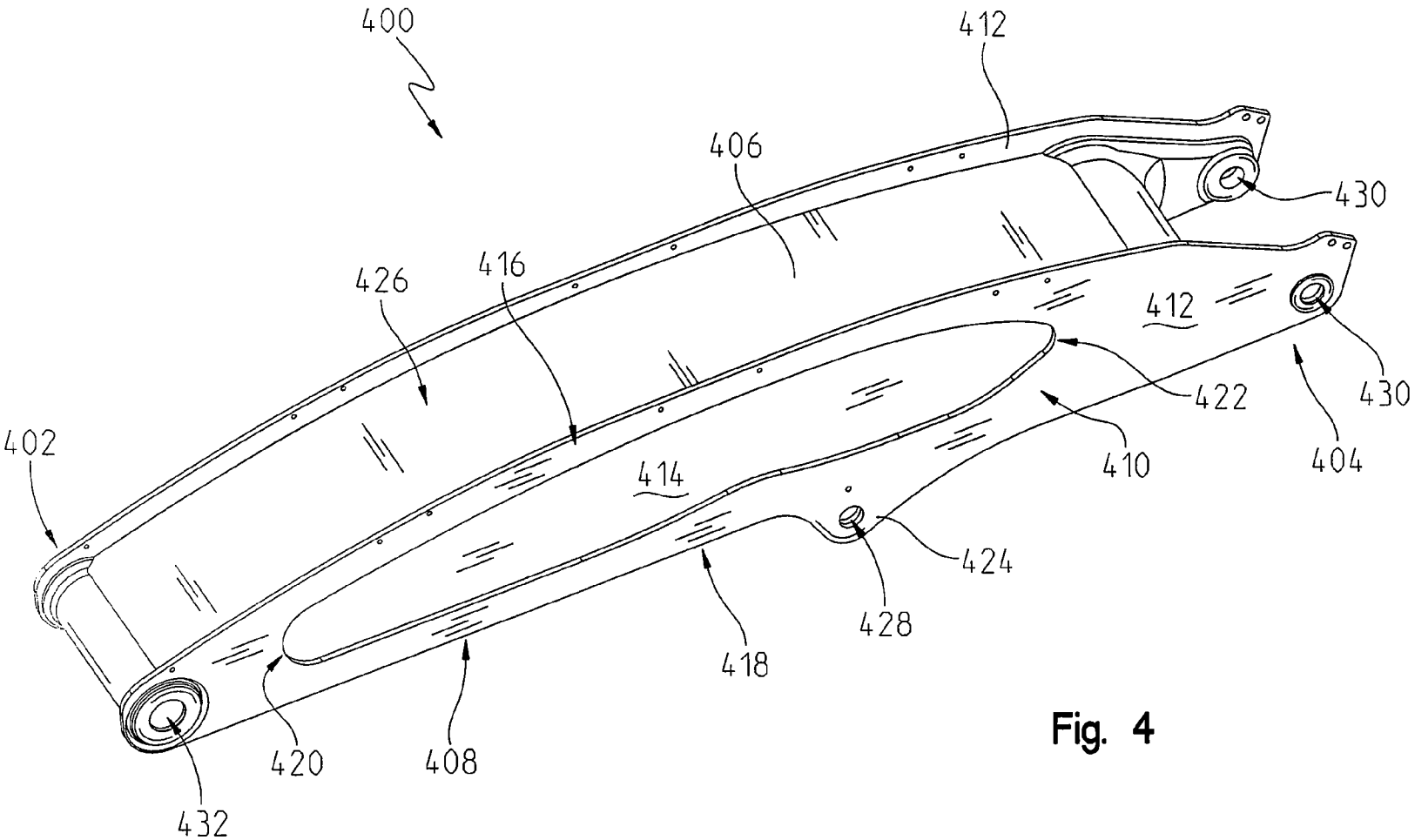
FIG. 4 is a perspective view of an exemplary boom having an improved exoskeleton.
Figure 5:
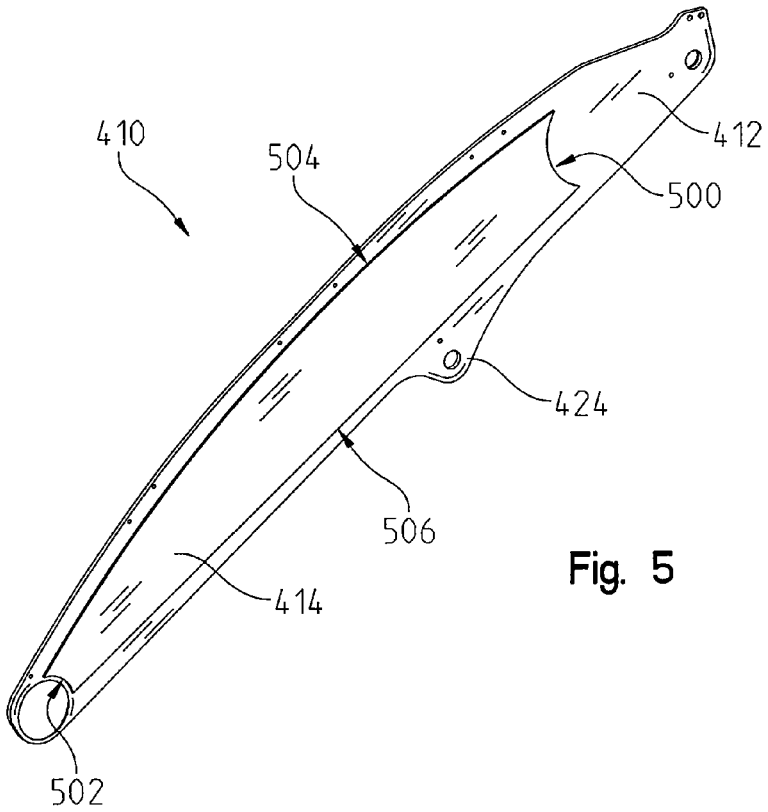
FIG. 5 is a side view of an inner surface of a side member of the boom of FIG. 4.
Figure 6:
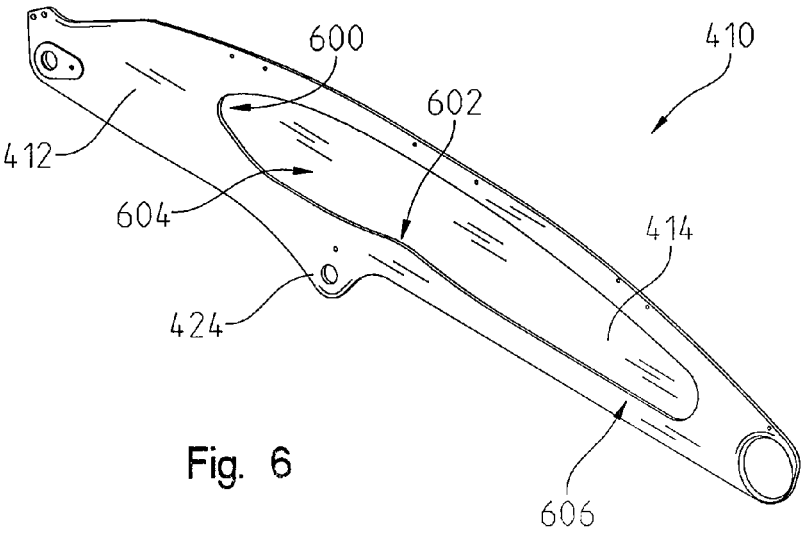
FIG. 6 is a side view of an outer surface of the side member of FIG. 5.

Referring to FIGS. 4-6, an exemplary embodiment of a boom 400 is shown. The boom 400 includes an elongated body frame defined by a top member 406, a bottom member 408, and a pair of side members 410. The boom 400 includes a first end 402 and a second end 404. The first end 402 includes means 432 for pivotally coupling to a dipper, for example, and the second end 404 includes means 430 for pivotally coupling to a support structure.

Figure 1:
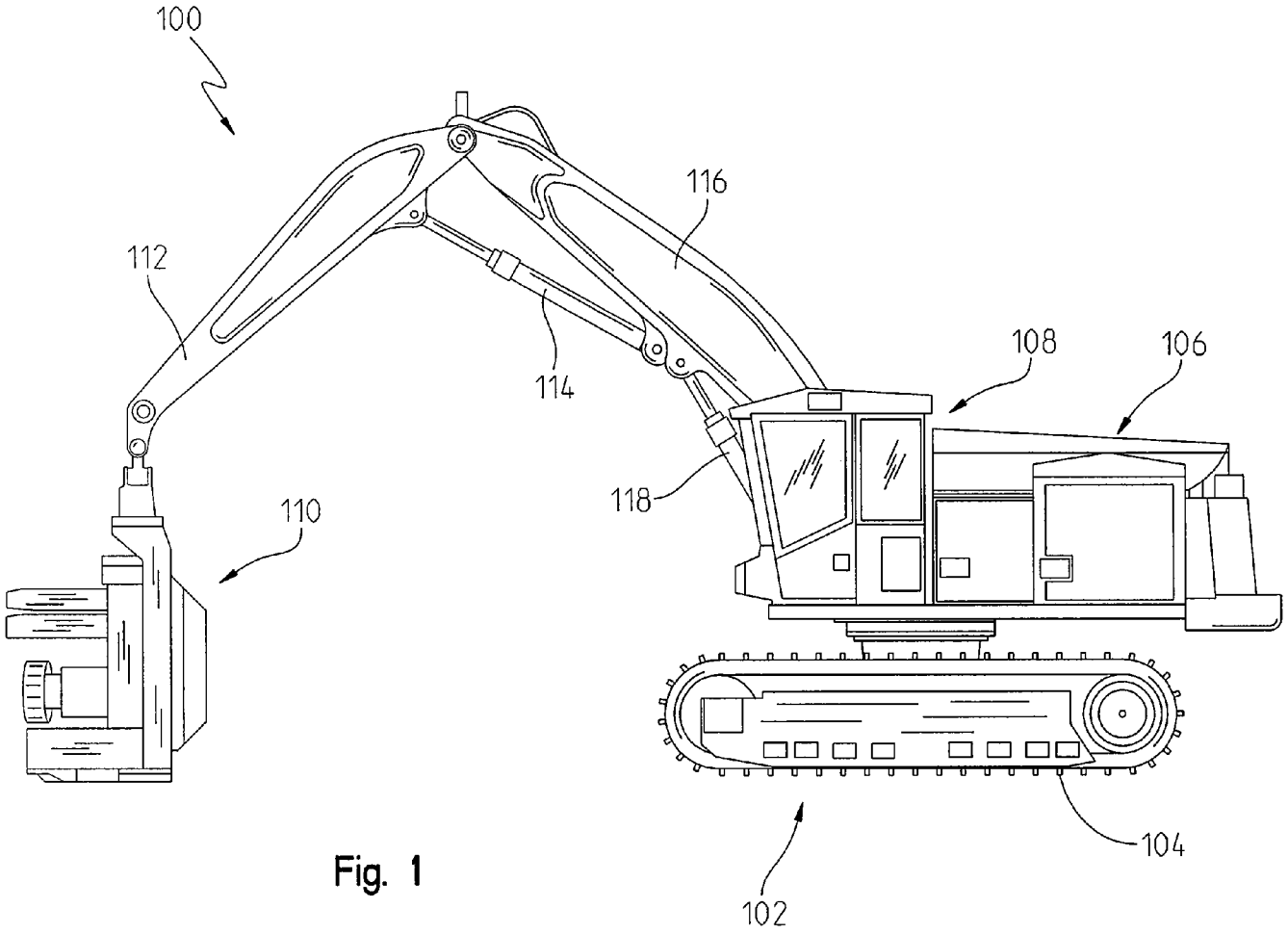
FIG. 1 is a rear perspective view of a work vehicle.

The boom 400 further includes a lug 424 that is formed as a portion of each side member 410. The lug 424 protrudes or extends in a direction towards the bottom member 408 and includes a defined opening 428 therethrough. In a work vehicle, similar to the one depicted in FIG. 1, the lug 424 provides a means for coupling a hydraulic cylinder to the boom 400 for operably controlling the boom 400.

Each of the side members 410 is structured to include a first frame body 412 and a second frame body 414. The first frame body 412 and second frame body 414 can be coupled to one another by welding, fastening, or other known means to form each side member 410. For purposes of this disclosure, the first frame body 412 has a greater thickness than the second frame body 414. For example, the first frame body 412 can have a thickness of approximately 20 mm and the second frame body 414 can have a thickness of about 10 mm. These thicknesses are only exemplary and not intended to be limiting to the scope of this disclosure. In other embodiments, the first frame body 412 can have a greater thickness than 15 mm and the second frame body can have a thickness less than 20 mm. Regardless of the embodiment, however, the first frame body 412 has a greater thickness than the second frame body 414.

Figure 2:
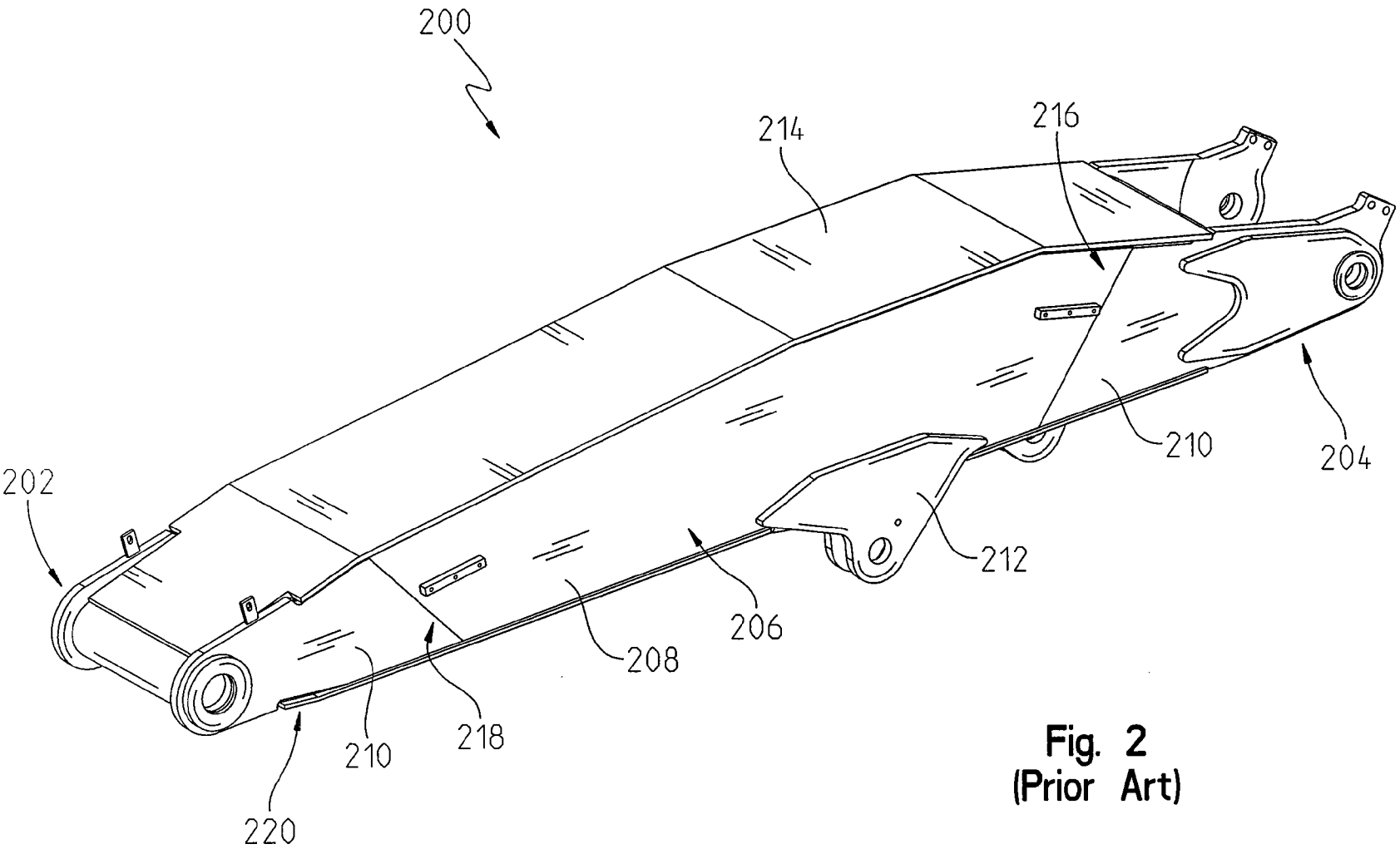
Fig. 2 (Prior Art)
FIG. 2 is a perspective view of a conventional boom.
Figure 3:
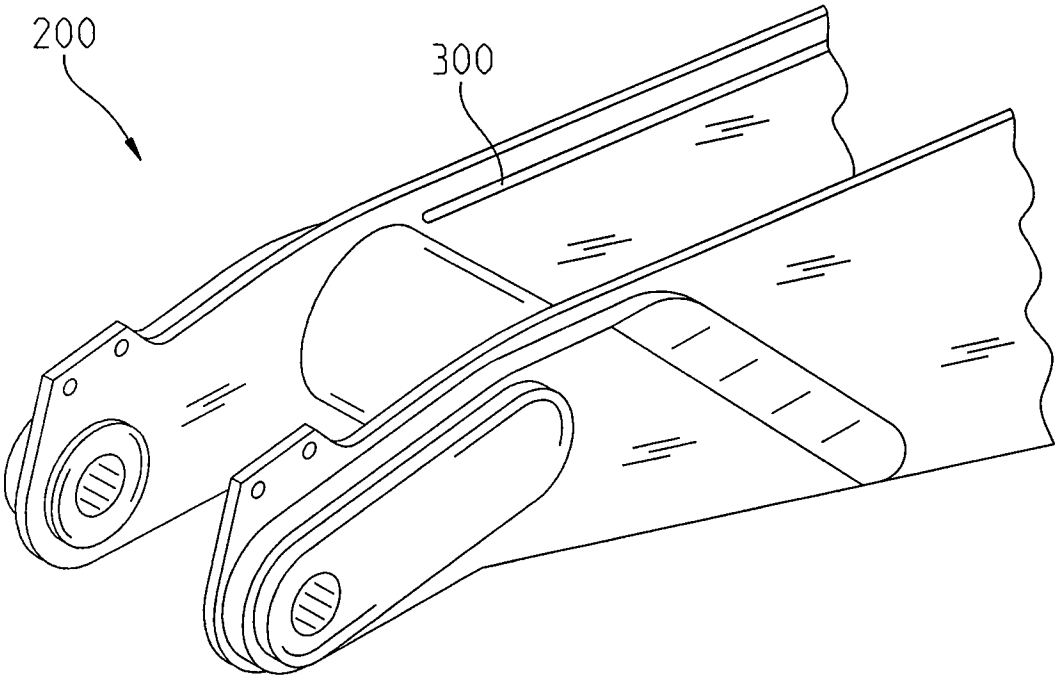
Fig. 3 (Prior Art)
FIG. 3 is a partially magnified perspective view of the conventional boom of FIG. 2.

In the illustrated embodiments of FIGS. 4 and 6, the first frame body 412 forms an outer frame 606 or boundary and the second frame body 414 is defined within this frame or boundary. In other words, the first frame body 412 defines an upper boundary 416, a lower boundary 418, and side boundaries 420, 422. As shown, the upper boundary 416, lower boundary 418, and side boundaries 420, 422 form a oval-like frame. The oval-like frame is substantially curved which reduces the overall stress at the interface of the first frame body 412 and second frame body 414. This is further illustrated in FIG. 6 by curved boundary 600 disposed near the side boundary 420. The lower boundary 418 can also include a raised portion 602 to strengthen the area proximate the lug 424. The added strength is possible due to the increased thickness and strength of the first frame body 412. As referenced above in FIG. 2, the conventional boom structure requires a support structure for the lug 212 separate from the thin portion 208 of the side member 206. This is due to the reduced strength present in the thin portion 208 and its inability to withstand loads exerted by a hydraulic cylinder.

Thus, one advantage of the boom structure 400 is the uniform and continuous frame structure 412 that incorporates the lug 424. Similarly, the first end 402 and second end 404 of the boom 400 are substantially incorporated into the first frame body 412. This structure does not include the welding or other coupling means as required by the conventional boom structure 200 and therefore stress risers and the like are reduced or eliminated from the boom structure 400.

Similarly, the conventional boom 200 requires separate materials at each end 202, 204 and the lug area 212 to be welded to the side member 206. These additional materials or features increase the overall cost of the boom 200. In the structural design of the boom 400, however, these additional materials or features are incorporated into a uniform, all-in-one design that costs less, does not require the numerous welding processes to form the side member, and further strengthens each side member 410 by reducing or eliminating stress risers.

Another advantage of the boom 400 is its improved rigidity over conventional booms. In the conventional boom 200, a substantial portion of the length of the top member 214 interfaces with the thin portion 208. During operation, trees, debris, and other objects can dent the thin portion 208 of the side member 206 due to its lack of rigidity. In some instances, the thin portion 208 can crack or be severely damaged due to these objects. In the structural design of the boom 400, however, the first frame body 412 substantially supports the side member 408 by forming an outer boundary of the side member 410 and thereby adds rigidity that is lacking in conventional boom structures.

In addition to strength and rigidity, a further advantage of this design is the ability to maintain a desired weight of the overall boom structure 400. Referring to FIG. 5, the second frame body 414 comprises a smaller circumference or perimeter than the first frame body 412. As shown, the second frame body 414 is defined by an elongated top surface 504, an elongated bottom surface 506, a first end 502, and a second end 500. The second end 500 is defined by a substantially concave edge, as shown in FIG. 5. Although smaller, the length of the second frame body 414 (e.g., the dimensions of the top surface 504 and bottom surface 506) is at least 50% of the length of the first frame body 412. In some embodiments, the length of the second frame member 414 can be 75% or more of the length of the first frame member 412. In other words, the second frame body 414 can define a substantial portion of the side member 410.

In addition, the internal edges of the upper boundary 416, lower boundary 418, and side boundaries 420, 422 define an open or window-like area 604 therebetween which is free of the thicker material that forms the first frame body 412. As shown in FIGS. 4 and 6, the second frame body 414 thereby defines this portion of the side member 410. This open area 604, combined with the reduced weight of the second frame body 414, provides an advantageous structural design for maintaining the overall boom weight at a desirable threshold.

Figure 7:
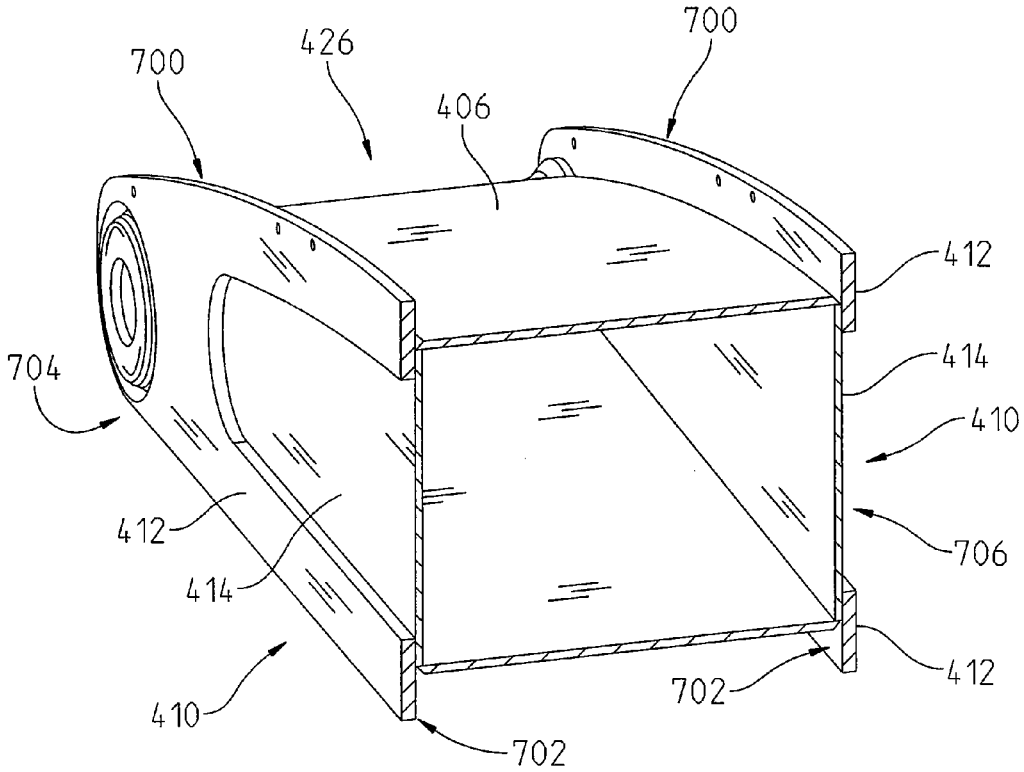
FIG. 7 is a cross-sectional perspective view of the boom of FIG. 4.
Figure 8:
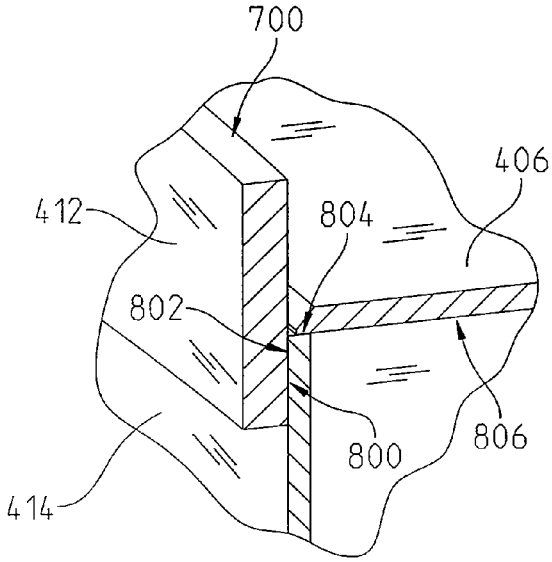
FIG. 8 is a magnified cross-sectional view of the boom of FIG. 4.

The arrangement of the first frame body 412 with respect to the top member 406 and bottom member 408 as shown in FIGS. 7 and 8 of the present disclosure. As shown, the top edge 700 of the first frame body 412 extends above the top member 406 of the boom on both a left side 704 and right side 706 of the boom. Likewise, a bottom edge 702 of the first frame body 412 extends downwardly past the bottom member 408. In this structural arrangement, the cross-section of the boom 400 has a substantially H-shaped configuration. Conventional booms generally have I-shaped cross-sectional configurations, and as described below and will be apparent to those skilled in the art, the H-shaped structural cross-section provides several advantages over the conventional design.

As noted above, conventional booms require a weld backup in the form of a plurality of support bars 300 to add strength and stability to the boom. However, these support bars have been unable to provide sufficient support to the welds and discontinuity between each bar often cause cracks or fractures. Embodiments of the present disclosure are able to overcome these disadvantages by providing a uniform, continuous support structure along the length of the boom 400. In particular, the second frame body 414 provides a continuous weld backup to support the welds between the top member 406, bottom member 408 and each side member 410.

Referring to FIG. 8, the first frame body 412 and second frame body 414 are coupled to one another along an outer surface 802 of the second frame body and an inner surface 800 of the first frame body. As described above, this can be achieved various ways including welding the respective surfaces 800, 802 to one another. Similarly, the top member 406 can be coupled (e.g., welded) to the second frame body 414. To do so, a weld can be disposed along an upper surface 804 of the second frame body 414 and a lower surface 806 of the top member 406. By doing so, the second frame body 414 becomes the joining interface or support structure between the top member 406 and each side member 410. The same can be done to couple the bottom member 408 and side members 410.

Since the outer surface 802 and upper surface 804 of the second frame body 414 extend along a substantial portion of the length of the boom 400, without discontinuity or interruption, the second frame body 414 provides a uniform, continuous weld backup for the boom structure. In addition, the boom structure can be constructed with a penetration weld, which is generally much stronger than a fillet weld used in many conventional booms 200. The other advantage is the second frame body 414 replaces backer support bars 300, which as described above, are difficult to position inside the boom and often provide inadequate support to the formed welds.

Figure 9:
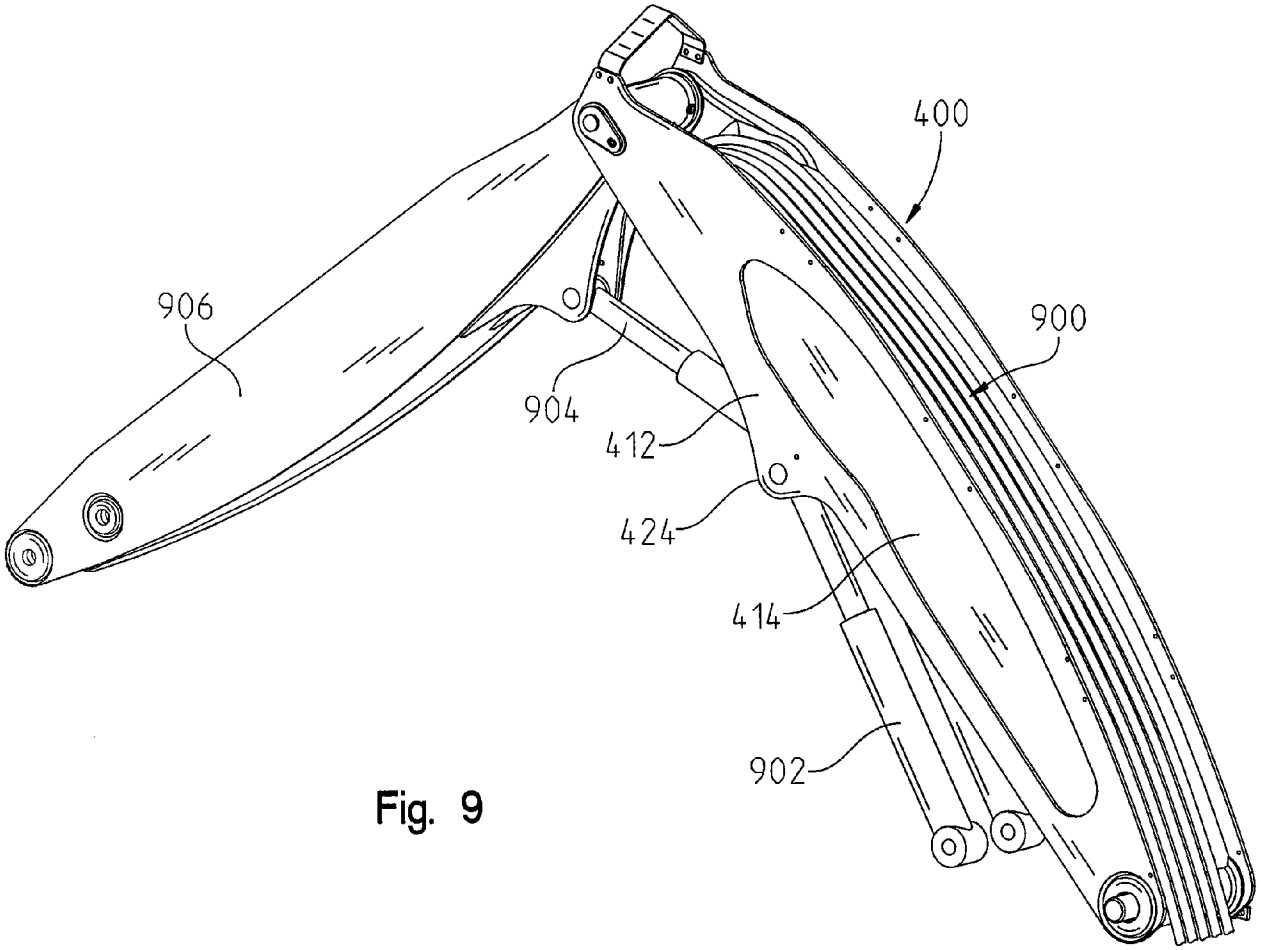
FIG. 9 is a perspective view of a boom and hose arrangement.

An additional advantage of the H-shaped cross-sectional boom structure is the ability to reposition or relocation hoses, fittings, wires, etc. Referring to FIG. 9, an embodiment of the boom 400 described above is coupled to a dipper 906. In this embodiment, a first hydraulic cylinder 902 can be actuated to control the movement of the boom 400 and a second hydraulic cylinder 904 can be actuated to control the movement of the dipper 906. Hoses 900, wires, fittings, etc. which are important to the functionality of the vehicle can be contained by the boom 400 to avoid being damaged by debris and other objects. Although not shown, hoses, wires, fittings, etc. are exposed to debris in conventional boom arrangements (e.g., boom 200) and were subjected to possible damage. Hoses, wires, fittings, etc. are often fastened or attached to the conventional boom 200 by using a protective shield-like structure (not shown) to hold these objects in place and reduce potential damage. Replacing damaged hoses, fittings, etc. can be costly and prevent a work vehicle from being operational.

As best shown in FIGS. 4 and 7, the top edge 700 of the first frame body 412 extends past the top member 406 on both the left side 704 and right side 706 of the boom 400 and from flange-like structures near the top of the boom 400. As a result, a recess or trough 426 is defined by the upper surface of the top member 406 and inner surface of the top edges 700. The depth of the recess 426 can be structured such that hoses 900, wires, fittings, etc. fit comfortably in the recess 426 and can be held therein by a bracket or similar bolt-on structure (not shown). In addition, the flange-like structures (e.g., top edges 700) are formed by the thicker material of the first frame body 412 and thus provides protection to the hoses 900, wires, fittings, etc. from debris. In addition, the recess 426 further eliminates the need of a protective bracket or bolt-on structure commonly found on conventional booms.

While exemplary embodiments incorporating the principles of the present invention have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A boom structure, comprising:

an elongated body having a length, a first end and a second end, the first end configured to couple to a dipper at one end of the length and the second end configured to couple to a support structure at the other end of the length;

a top member and a bottom member of the body; and a pair of side members of the body coupled to the top member and bottom member, each side member comprising:

a first portion extending along the length of the elongated body and from the first end to the second end of the elongated body and forming an outer frame structure, the first portion including an outer surface, an inner surface, and defining a through opening disposed between the outer surface and the inner surface; and a second portion coupled to the top member and to the inner surface of the first portion and being substantially disposed within the outer frame structure, wherein the second portion extends along a substantial portion of the length of the elongated body and from a location adjacent to the top member to a location adjacent to the bottom member and the second portion includes an elongated top edge; and the top member and first portion welded together at exposed surfaces of the first portion and the top member, the bottom member and first portion welded together at exposed surfaces of the first portion and the bottom member; and a top edge of the second portion is welded to a bottom edge of the top member; and a bottom edge of the of the second portion is welded to a top edge of the bottom member; and the second portion is configured to provide a uniform and continuous and uninterrupted weld backup located at a joining interface disposed at the elongated top edge of the second portion and between the top member, the first portion, and the second portion, wherein the joining interface at the second portion forms the weld backup at the exposed surfaces of the first portion, the second portion and the top member, wherein the exposed surfaces at the joining interface include a surface of each of the top portion and the first portion and the elongated top edge of the second portion, such that the continuous and uninterrupted weld backup is made on the exposed surfaces of the top portion and the first portion, and the elongated top edge of the second portion;

wherein the joining interface is continuous and uninterrupted along a substantial length of a surface of the top member and the continuous and uninterrupted weld backup extends along the substantial length of the top member such that the second portion is configured as a support structure between the top member and the pair of side members.

2. The boom structure of claim 1, further comprising a lug portion defined by the first portion.

3. The boom structure of claim 1, further comprising a penetration weld formed between the first mentioned joining interface of the first portion and second portion, and the top member and a second joining interface disposed at an elongated bottom edge of the second portion, the first portion and the bottom member, wherein the first mentioned joining interface is defined by exposed surfaces of the first portion, the second portion and the top member, and the second joining interface is defined by exposed surfaces of the first portion, the second portion, and the bottom member.

4. The boom structure of claim 1, further comprising a substantially H-shaped cross-section defined at the interface of the top member, first portion and second portion, wherein the first portion extends past the top member to define a trough configured to locate one of hoses, wires and fittings.

5. The boom structure of claim 1, wherein the second portion completely overlaps the defined opening in the first portion.

6. The boom structure of claim 1, wherein the first portion extends past the top member to define a flange-like structure.

7. The boom structure of claim 1, further comprising a recess defined between the top member and first portion of the pair of side members.

8. The boom structure of claim 1, wherein the first portion has a greater thickness than the second portion.

9. The boom structure of claim 1 wherein the first portion includes a single through opening having a length longer than a height thereof as determined along the length of the elongated body.

10. The boom structure of claim 9 further comprising a coupling means configured to couple the first portion to the second portion at a location other than the location of the continuous weld backup.

11. The boom structure of claim 1 wherein the joining interface at the second portion includes an elongated bottom edge of the second portion, such that the continuous weld backup is made on the surfaces of the top portion and the first portion, and the elongated bottom edge of the second portion.

12. The boom structure of claim 1 wherein the second portion extends along a substantial portion of the length of the elongated body of at least fifty percent.

13. The boom structure of claim 12 wherein the second portion extends along a substantial portion of the length of the elongated body of at least seventy-five percent.

14. The boom structure of claim 1 wherein the first portion consists of a one-piece part and the second portion consists of a one-piece part.

15. A work vehicle, comprising:

an undercarriage and a ground engaging assembly for supporting and propelling the vehicle;

a support structure disposed upon the undercarriage; a work attachment for performing a work operation; a dipper stick pivotally coupled to the work attachment; and a boom pivotally coupled to the dipper stick at a first end and to the support structure at a second end thereof, the boom comprising:

an elongated body having a length extending from the first end to the second end, a top member and a bottom member; and a pair of side members coupled to the top member and bottom member, each side member including a first portion consisting of a one piece part and a second portion consisting of a one piece part, where the first portion extends along the length between the first end and the second end of the body and forms an outer frame structure, the first portion including an outer surface, an inner surface, and defining a through opening disposed between the outer surface and the inner surface, and the second portion is coupled to the inner surface of the first portion and is substantially enclosed by the first portion, wherein the second portion extends from a location adjacent to the top member and to a location adjacent to the bottom member; and the top member and first portion welded together at exposed surfaces of the first portion and the top member, the bottom member and first portion welded together at exposed surfaces of the first portion and the bottom member; and a top edge of the second portion is welded to a bottom edge of the top member; and a bottom edge of the of the second portion is welded to a top edge of the bottom member; and the second portion;

wherein, the first portion has a greater thickness than the second portion and the second portion is configured to provide a continuous and uninterrupted weld backup located at a joining interface disposed at the second portion and between exposed surfaces of the top member, the first portion, and the second portion, wherein the exposed surfaces at the joining interface include a surface of each of the top portion and the first portion and the elongated top edge of the second portion, such that the continuous and uninterrupted weld backup is made on the exposed surfaces of the top portion and the first portion, and the elongated top edge of the second portion;

wherein the joining interface is continuous and uninterrupted along a substantial length of a surface of the top member wherein the continuous and uninterrupted weld backup extends along the substantial length of the top member, such that the second portion is configured as a support structure between the top member and the pair of side members.

16. The work vehicle of claim 15, further comprising a penetration weld formed between the first mentioned joining interface of the first portion and second portion, and the top member and a second joining interface disposed at an elongated bottom edge of the second portion, the first portion and the bottom member, wherein the first mentioned joining interface is defined by exposed surfaces of the first portion, the second portion and the top member, and the second joining interface is defined by exposed surfaces of the first portion, the second portion, and the bottom member.

17. The work vehicle of claim 15, further comprising a substantially H-shaped cross-section defined at the interface of the top member, first portion and second portion, wherein the first portion extends past the top member to define a trough configured to locate one of hoses, wires, and fittings.

18. The work vehicle of claim 15, wherein:

the second portion completely covers the defined through opening.

19. The work vehicle of claim 15, further comprising a recess defined between the top member and first portion of the pair of side members.

20. The work vehicle of claim 15, wherein the first portion extends past the top member to define a flange-like structure.

21. The work vehicle of claim 15 wherein the first portion includes a single through opening having a length longer than a height thereof as determined along the length of the elongated body.

22. The work vehicle of claim 21 further comprising a coupling means configured to couple the first portion to the second portion at a location other than the location of the continuous weld backup.

* * * * *